US008581827B2

(12) United States Patent
Park et al.

(10) Patent No.: US 8,581,827 B2
(45) Date of Patent: Nov. 12, 2013

(54) BACKLIGHT UNIT AND LIQUID CRYSTAL DISPLAY HAVING THE SAME

(75) Inventors: Byoung-Hwa Park, Cheonan-si (KR); Ho-Sup Choi, Seoul (KR); Sang-Youn Kim, Cheonan-si (KR); Kyu-Min Kwon, Asan-si (KR)

(73) Assignee: Samsung Display Co. Ltd., Yongin, Gyeonggi-Do (KR)

( * ) Notice: Subject to any disclaimer, the term of this patent is extended or adjusted under 35 U.S.C. 154(b) by 720 days.

(21) Appl. No.: 12/358,774

(22) Filed: Jan. 23, 2009

(65) Prior Publication Data

US 2010/0033421 A1 Feb. 11, 2010

(30) Foreign Application Priority Data

Aug. 6, 2008 (KR) ..... 10-2008-0077042

(51) Int. Cl.
*G09G 3/36* (2006.01)

(52) U.S. Cl.
USPC ..... 345/102

(58) Field of Classification Search
None
See application file for complete search history.

(56) References Cited

U.S. PATENT DOCUMENTS

| | | | | |
|---|---|---|---|---|
| 7,923,943 | B2 * | 4/2011 | Peker et al. | 315/312 |
| 2003/0151601 | A1 * | 8/2003 | Chung et al. | 345/211 |
| 2009/0295706 | A1 * | 12/2009 | Feng | 345/102 |

FOREIGN PATENT DOCUMENTS

| | | |
|---|---|---|
| CN | 1766708 A | 5/2006 |
| CN | 1954354 | 4/2007 |
| CN | 101201487 | 6/2008 |
| JP | 2002-082326 | 3/2002 |
| JP | 2004-191836 | 7/2004 |
| JP | 2004-206003 | 7/2004 |

OTHER PUBLICATIONS

English Abstract for Publication No. 2002-082326.
English Abstract for Publication No. 2004-191836.
English Abstract for Publication No. 2004-206003.
English Abstract for Publication No. CN 101201487.
English Abstract for Publication No. CN 1766708 A, 2006.
English Abstract for Publication No. CN1954354, 2007.

* cited by examiner

*Primary Examiner* — Joseph Haley
*Assistant Examiner* — Emily Frank
(74) *Attorney, Agent, or Firm* — F. Chau & Associates, LLC

(57) ABSTRACT

A liquid crystal display includes a liquid crystal panel that displays an image signal, a backlight unit supplying light to the liquid crystal panel, and a backlight control circuit to scan the backlight unit. The backlight control circuit supplies a pulse width modulation signal to rows of the backlight unit, which are adjacent to rows being scanned, such that the rows adjacent to the rows being scanned have a brightness lower than a brightness of the rows being scanned.

15 Claims, 8 Drawing Sheets

BACKLIGHT UNIT AND LIQUID CRYSTAL DISPLAY HAVING THE SAME

CROSS-REFERENCE TO RELATED APPLICATION

This application claims priority from Korean Patent Application No. 2008-77042 filed on Aug. 6, 2008, the contents of which are herein incorporated by reference in their entirety.

BACKGROUND

1. Field of the Invention

The present disclosure is directed to a backlight unit and a liquid crystal display having the backlight unit.

2. Description of the Related Art

A liquid crystal display includes a backlight unit, a driving circuit unit and a liquid crystal panel. The backlight unit supplies light to the liquid crystal panel and the driving circuit unit drives the liquid crystal panel. The liquid crystal panel includes liquid crystal cells aligned in the form of a matrix. Light transmittance of each liquid crystal cell varies depending on voltage applied to the liquid crystal cell. That is, the liquid crystal display adjusts the light transmittance of the liquid crystal cell by using the driving circuit and supplies light to the liquid crystal cell by using the backlight unit, thereby displaying images.

Image signals displayed on the liquid crystal panel are sequentially scanned in the row direction. That is, the image signals are scanned from the upper portion to the lower portion of the liquid crystal panel. The scanning method is employed in the backlight unit to reduce motion blur. Similarly to the liquid crystal panel, the backlight unit is scanned in the row direction.

Since the image signals and the backlight unit are scanned, there are liquid crystal cells that are charged, that is, are subject to an applied voltage, when the backlight unit is in the ON state. If light is supplied to such liquid crystal cells from the backlight unit, capacitance of the liquid crystal cells is changed, causing leakage current. That is, a light transmittance of liquid crystal cells, which are charged when the backlight unit is in the ON state, is different from that of liquid crystal cells, which are charged when the backlight unit is in the OFF state. Such difference in light transmittance causes a difference in brightness of images displayed on the liquid crystal panel. Since the liquid crystal cells are charged in a unit of a row, a brightness difference occurs between rows. Such brightness difference causes a waterfall in the liquid crystal panel.

SUMMARY

Exemplary embodiments of the present invention provide a backlight unit capable of reducing/preventing waterfall.

Exemplary embodiments of the present invention provide a liquid crystal display having the backlight unit.

In an exemplary embodiment of the present invention, a liquid crystal display includes a liquid crystal panel that displays an image signal, a backlight unit supplying light to the liquid crystal panel, and a backlight control circuit that controls brightness of the backlight unit. The backlight control circuit supplies a pulse width modulation signal to rows of the backlight unit that are adjacent to rows being scanned such that the rows adjacent to the rows being scanned have a brightness lower than a brightness of the rows being scanned.

The scanning control circuit performs a pre-scanning by supplying the second pulse width modulation signal to rows to be scanned in a next scanning timing. If a row to be scanned is a first row of the backlight unit, the scanning control circuit does not perform pre-scanning. The pulse width modulation signal supplied to the rows to be scanned is determined according to the pulse width modulation signal supplied to the rows being scanned that are adjacent to the rows to be scanned. Brightness according to the pulse width modulation signal supplied to the rows to be scanned corresponds to 1/n of brightness according to the pulse width modulation signal supplied to the rows being scanned that are adjacent to the rows to be scanned.

The scanning control circuit performs a post-scanning by supplying the pulse width modulation signal to the rows that have been scanned in a previous timing. The scanning control circuit does not perform post-scanning if the scanned row is a last row of the backlight unit. The pulse width modulation signal supplied to the rows that have been scanned is determined according to the pulse width modulation signal supplied to the rows being scanned that are adjacent to the scanned rows. Brightness according to the pulse width modulation signal supplied to the scanned rows corresponds to 1/n of brightness obtained from the pulse width modulation signal supplied to the rows being scanned that are adjacent to the scanned rows.

In another exemplary embodiment of the present invention, a backlight unit includes a backlight unit supplying light to a liquid crystal panel, and a backlight control circuit that controls brightness of the backlight unit. The backlight control circuit supplies a first pulse width modulation signal to rows adjacent to rows being scanned. The first pulse width modulation signal has a level lower than that of a second pulse width modulation signal supplied to the rows being scanned.

The backlight control circuit performs a pre-scanning by supplying the pulse width modulation signal to rows to be scanned in a next scanning timing.

The backlight control circuit performs a post-scanning by supplying the pulse width modulation signal to rows that have been scanned in a previous scanning timing.

According to the above, a brightness difference can be reduced in the row direction of the backlight unit, so that waterfall can be reduced.

DETAILED DESCRIPTION OF EXEMPLARY EMBODIMENTS

A backlight unit and a liquid crystal display having the same according to an embodiment of the present invention provide a pulse width modulation signal to rows adjacent to rows being scanned in a backlight unit. The pulse width modulation signal supplied to the adjacent rows corresponds to brightness that is lower than brightness obtained from a pulse width modulation signal supplied to the rows being scanned. Hereinafter, exemplary embodiments of the present invention will be explained in detail with reference to the accompanying drawings.

Figure 1:
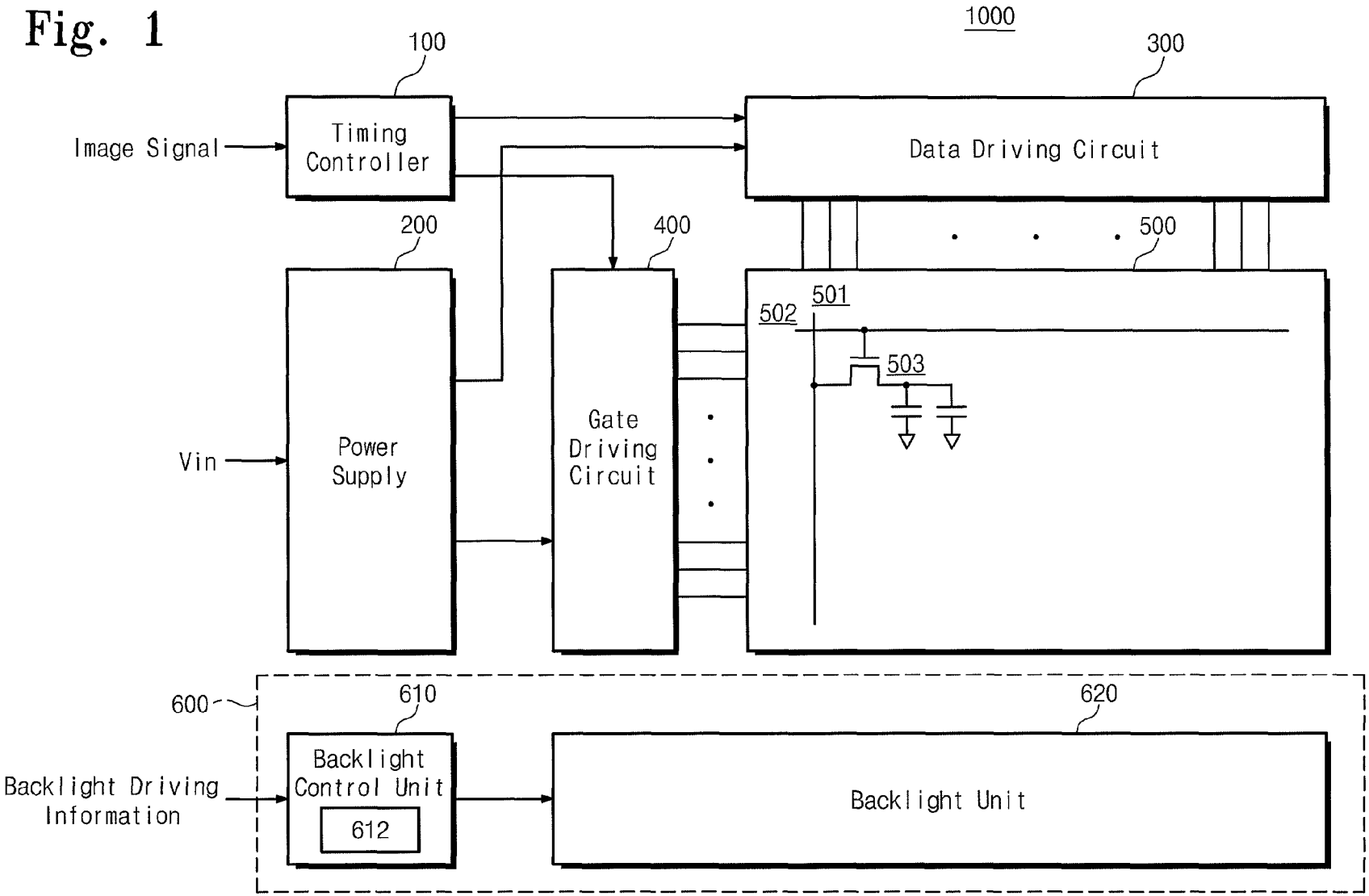
FIG. 1 is a block diagram showing a liquid crystal display according to an exemplary embodiment of the present invention.

FIG. 1 is a block diagram showing a liquid crystal display according to an exemplary embodiment of the present invention.

Referring to FIG. 1, a liquid crystal display 1000 includes a timing controller 100, a power supply 200, a data driving circuit 300, a gate driving circuit 400, a liquid crystal panel 500, and a backlight unit 600.

The timing controller 100 controls the data driving circuit 300 and the gate driving circuit 400 in response to image signals supplied from an outside source. For example, the timing controller 100 may receive digital image signals R, G and B. The timing controller 100 generates gate control signals in response to the digital image signals R, G and B. The gate control signals are transmitted to the gate driving circuit 400. In addition, the timing controller 100 generates data control signals in response to the digital image signals R, G and B. The data control signals are transmitted to the data driving circuit 300.

The power supply 200 supplies power to the data driving circuit 300 and the gate driving circuit 400. For example, the power supply 200 receives an input voltage Vin from an outside source to generate a gate-on voltage Von, a gate-off voltage Voff, a gamma voltage, etc. The gamma voltage is transmitted to the data driving circuit 300 and the gate-on voltage Von and the gate-off voltage Voff are transmitted to the gate driving circuit 400. A driving voltage VDD serves as operating voltage for each component of the liquid crystal display 1000. Although not shown in FIG. 1, the power supply 200 further generates a common voltage Vcom. The common voltage Vcom is transmitted to the liquid crystal panel 500.

The data driving circuit 300 receives power from the power supply 200 and operates in response to the control signal from the timing controller 100. The data driving circuit 300 generates analog gray scale voltages, which correspond to digital image signals R, G and B supplied from the timing controller 100, by using the gamma voltage transferred from the power supply 200. Whenever the gate-on voltage Von is applied to gate lines of the liquid crystal panel 500, the data driving circuit 300 supplies the analog gray scale voltage to data lines.

The gate driving circuit 400 receives power from the power supply 200 and operates in response to the control signal from the timing controller 100. The gate driving circuit 400 receives the gate on voltage Von and the gate off voltage Voff from the power supply 200. The gate driving circuit 400 sequentially applies the gate-on voltage Von and the gate-off voltage Voff to the gate lines of the liquid crystal panel 500 under the control of the timing controller 100.

The liquid crystal panel 500 is connected to the data driving circuit 300 through the data lines, and is connected to the gate driving circuit 400 through the gate lines. The liquid crystal panel 500 includes a plurality of liquid crystal cells connected to the data lines and the gate lines. One data line 501, one gate line 502, and one liquid crystal cell 503 are shown in FIG. 1 for the purpose of simplicity. The liquid crystal panel 500 has a plurality of liquid crystal cells aligned in the form of a matrix. As the gate-on voltage Von is applied to the gate line, the transistor of the liquid crystal cell is turned on. As the analog gray voltage is applied to the data line, a capacitor of the liquid crystal cell is charged with an analog gray voltage. In addition, the transistor of the liquid crystal cell is turned off as the gate-off voltage is applied to the gate line. The liquid crystal cell drives the liquid crystal according to the voltage applied therein, thereby adjusting light transmittance.

The backlight unit 600 supplies light to the liquid crystal panel 500 in response to backlight driving information received from an outside source. For example, the backlight driving information can include brightness information of an image. The backlight unit 600 includes a backlight control circuit 610 and a backlight unit 620.

The backlight control circuit 610 adjusts brightness of the backlight unit 620 in response to the backlight driving information received from the outside source. For example, the backlight control circuit 610 controls a pulse width of a pulse width modulation signal to adjust brightness of the image.

The backlight control circuit 610 includes a scanning control circuit 612. The scanning control circuit 612 controls scanning operation for the backlight unit 620. For example, the scanning control circuit 612 scans the backlight unit 620 in the row direction. In addition, the scanning control circuit 612 provides a pulse width modulation signal to rows adjacent to rows being scanned in the backlight unit 620. The pulse width modulation signal supplied to the adjacent rows has a brightness that is lower than the brightness obtained from a pulse width modulation signal supplied to the rows being scanned. For example, the scanning control circuit 612 provides the pulse width modulation signal to the row to be scanned in the next scanning timing, thereby performing the pre-scanning. Then, the scanning control circuit 612 provides the pulse width modulation signal to the row that has been scanned in the previous scanning timing, thereby performing the post-scanning. The scanning operation for the backlight unit 620 will be described later in more detail with reference to FIG. 2.

The liquid crystal cells of the liquid crystal panel 500 may be charged when the backlight unit 620 is in the ON or OFF state. If the light is supplied from the backlight unit 620 to liquid crystal cells that are charged when the backlight unit 620 is in the OFF state, leakage current may occur in the liquid crystal cells. That is, light transmittance of the liquid crystal cell is changed by the light supplied from the backlight unit 620. In other words, the light transmittance of the liquid crystal cell is changed due to a difference in brightness between the turn-on state and the turn-off state of the backlight unit, so that the waterfall is generated.

When the scanning is performed with respect to the backlight unit 620, one row of the backlight unit is maintained in the ON state for a predetermined time, and then maintained in the OFF state during the remaining time. That is, when the backlight unit 620 is scanned, the ON time of the backlight unit 620 is reduced as compared with the ON time of the backlight unit 620 when the backlight unit 620 is not scanned. Thus, the brightness of the image when the backlight unit 620 is scanned is lower than the brightness of the image when the backlight unit 620 is not scanned. For this reason, the backlight unit 620 is boosted during the scanning operation to compensate for the brightness. Therefore, when the scanning operation is performed, brightness difference between the ON state and the OFF state of the backlight unit 620 may increase as compared with the brightness difference obtained when the scanning operation is not performed, so that the waterfall is increased.

To reduce or prevent the waterfall, the scanning control circuit 620 provides a pulse width modulation signal to the rows adjacent to the rows being scanned that has a lower brightness than the brightness obtained from the pulse width modulation signal supplied to the rows being scanned.

Figure 2:
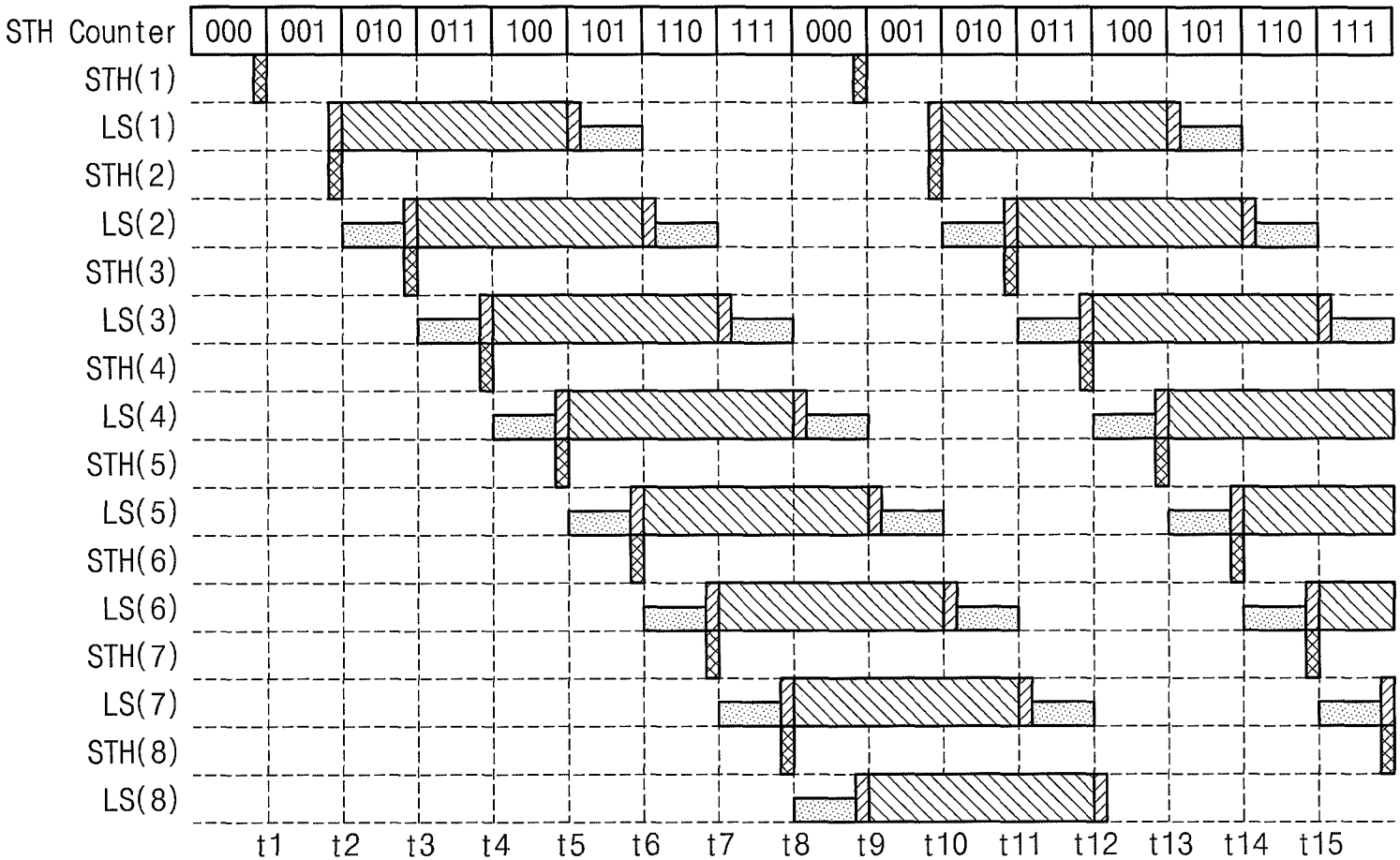
FIG. 2 is a timing diagram showing a scanning timing for a backlight unit according to an exemplary embodiment of the present invention.

FIG. 2 is a timing diagram showing a scanning timing for the backlight unit 620 according to an exemplary embodiment of the present invention. In FIG. 2, an x-axis represents time and a y-axis represents various signals. In addition, a box filled with "x" represents an STH (starting horizon) signal, a box filled with leftward inclined oblique lines represents a latch signal, and a box filled with dots or rightward inclined oblique lines represents a pulse width modulation (PWM)

signal. The brightness corresponding to the PWM signal of the box filled with the dots is lower than the brightness corresponding to the PWM signal of the box filled with the rightward inclined oblique lines.

FIGS. 3 to 14 are diagrams showing a scanning procedure according to an embodiment of the invention for the backlight unit, which is performed according to the scanning timing shown in FIG. 2.

Referring to FIGS. 3 to 14, the first STH signal STH1 corresponding to the first row of the backlight unit 620 is activated at first time (t1). If the first STH signal STH1 is activated, a STH counter value is increased from "000" to "001". The first latch signal LS1 is activated in response to the first STH signal STH1 at second time (t2). The PWM signal corresponding to the brightness of the first row of the backlight unit 620 is supplied to the first row of the backlight unit 620 in response to the first latch signal LS1.

The second STH signal STH2 corresponding to the second row of the backlight unit 620 is activated at second time (t2). The second row of the backlight unit 620 is scanned in the next scanning timing. The scanning control circuit 612 supplies the PWM signal to the row to be scanned in the next timing, that is, the second row of the backlight unit 620, to perform the pre-scanning. The PWM signal supplied to the row to be scanned is determined according to the PWM signal supplied to the row being scanned that is adjacent to the row to be scanned, that is, the first row of the backlight unit 620. For example, the brightness according to the PWM signal supplied to the row to be scanned (that is, the second row) is 1/n of the brightness according to the PWM signal supplied to the row being scanned (that is, the first row). Since the second STH signal STH2 is activated, the STH counter value is increased from "001" to "010".

Figure 3:
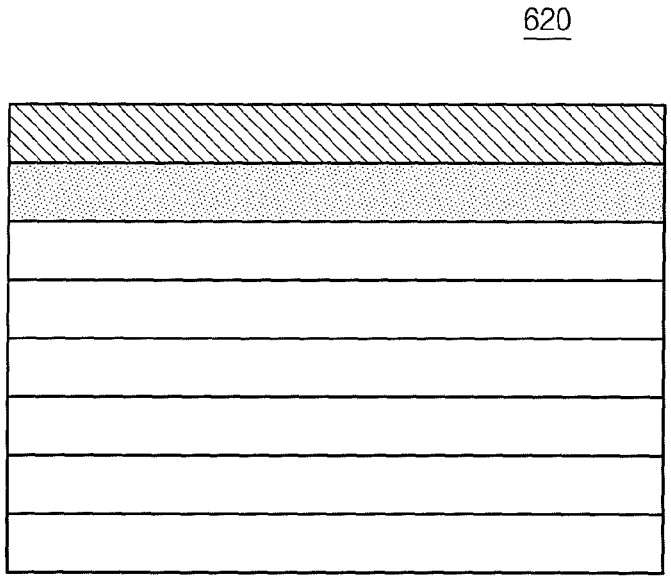
FIGS. 3 to 14 are diagrams showing the scanning procedure for a backlight unit, which is performed according to the scanning timing shown in FIG. 2.

The backlight unit 620 corresponding to an interval between times (t2 and t3) is shown in FIG. 3. The PWM signal corresponding to the brightness of the first row is supplied to the first row of the backlight unit 620, and the PWM signal corresponding to 1/n of the brightness of the first row is supplied to the second row of the backlight unit 620. For example, the PWM signal corresponding to ½ of the brightness of the first row is supplied to the second row of the backlight unit 620.

The second latch signal LS2 is activated and the PWM signal corresponding to the brightness of the second row of the backlight unit 620 is supplied to the second row of the backlight unit 620 at third time (t3). In addition, the third STH signal STH3 corresponding to the third row of the backlight unit 620 is activated. That is, the third row of the backlight unit 620 is scanned in the next scanning timing. The scanning control circuit 612 supplies the PWM signal to the row to be scanned in the next timing, that is, the third row of the backlight unit 620, to perform the pre-scanning. The PWM signal supplied to the row to be scanned is determined according to the PWM signal supplied to the row being scanned that is adjacent to the row to be scanned, that is, the second row of the backlight unit 620. For example, the brightness according to the PWM signal supplied to the row to be scanned (that is, the third row) is 1/n of the brightness according to the PWM signal supplied to the row being scanned that is adjacent to the third row (that is, the second row). Since the third STH signal STH3 is activated, the STH counter value is increased from "010" to "011".

Figure 4:
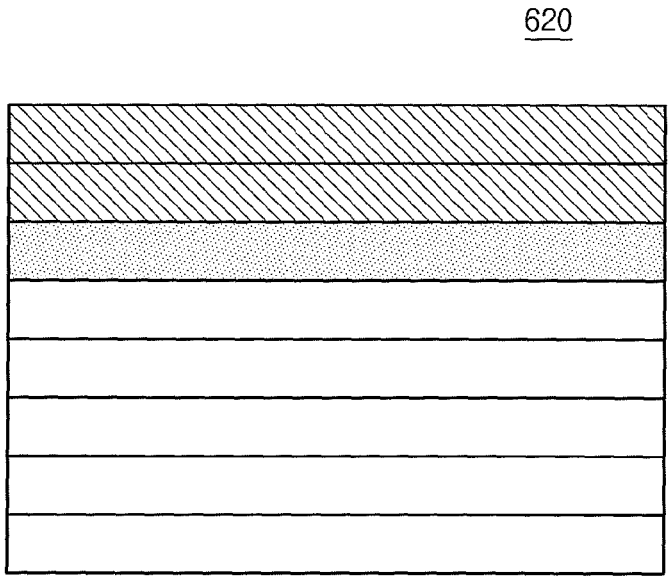

The backlight unit 620 corresponding to an interval between times (t3 and t4) is shown in FIG. 4. The PWM signal corresponding to the brightness of the first and second rows of the backlight unit 620 is supplied to the first and second rows of the backlight unit 620, and the PWM signal corresponding to 1/n of the brightness of the second row is supplied to the third row of the backlight unit 620. For example, the PWM signal corresponding to ½ of the brightness of the second row is supplied to the third row of the backlight unit 620.

The third latch signal LS3 is activated and the PWM signal corresponding to the brightness of the third row of the backlight unit 620 is supplied to the third row of the backlight unit 620 at fourth time (t4). In addition, the fourth STH signal STH4 corresponding to the fourth row of the backlight unit 620 is activated. That is, the fourth row of the backlight unit 620 is scanned in the next scanning timing. The scanning control circuit 612 supplies the PWM signal to the row to be scanned in the next timing, that is, the fourth row of the backlight unit 620, to perform the pre-scanning. The PWM signal supplied to the row to be scanned is determined according to the PWM signal supplied to the row being scanned that is adjacent to the row to be scanned, that is, the third row of the backlight unit 620. For example, the brightness according to the PWM signal supplied to the row to be scanned (that is, the fourth row) is 1/n of the brightness according to the PWM signal supplied to the row being scanned that is adjacent to the fourth row (that is, the third row). Since the fourth STH signal STH4 is activated, the STH counter value is increased from "011" to "100".

Figure 5:
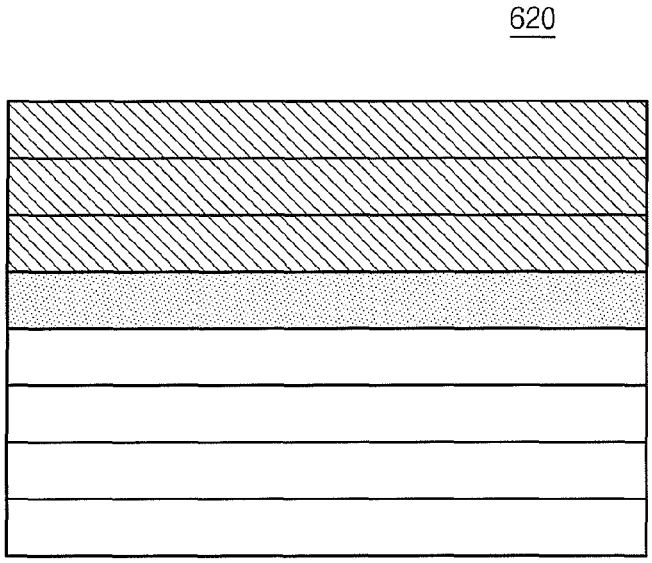

The backlight unit 620 corresponding to an interval between times (t4 and t5) is shown in FIG. 5. The PWM signal corresponding to the brightness of the first to third rows of the backlight unit 620 is supplied to the first to third rows of the backlight unit 620, and the PWM signal corresponding to 1/n of the brightness of the third row is supplied to the fourth row of the backlight unit 620. For example, the PWM signal corresponding to ½ of the brightness of the third row is supplied to the fourth row of the backlight unit 620.

The fourth latch signal LS4 is activated and the PWM signal corresponding to the brightness of the fourth row of the backlight unit 620 is supplied to the fourth row of the backlight unit 620 at fifth time (t5). In addition, the first latch signal LS1 corresponding to the first row of the backlight unit 620 is deactivated. That is, the scanning for the first row of the backlight unit 620 is completed. At this time, the scanning control circuit 612 performs the post-scanning by supplying the PWM signal to the row of the backlight unit 612 which has been scanned, that is, the first row of the backlight unit 620. The PWM signal supplied to the scanned row is determined according to the PWM signal supplied to the row being scanned that is adjacent to the scanned row, that is, the second row of the backlight unit 620. For example, the brightness according to the PWM signal supplied to the scanned row (that is, the first row) is 1/n of the brightness according to the PWM signal supplied to the row being scanned that is adjacent to the first row (that is, the second row).

In addition, the fifth STH signal STH5 corresponding to the fifth row of the backlight unit 620 is activated. That is, the fifth row of the backlight unit 620 is scanned in the next scanning timing. The scanning control circuit 612 supplies the PWM signal to the row to be scanned in the next timing, that is, the fifth row of the backlight unit 620, to perform the pre-scanning. The PWM signal supplied to the row to be scanned is determined according to the PWM signal supplied to the row being scanned that is adjacent to the row to be scanned, that is, the fourth row of the backlight unit 620. For example, the brightness according to the PWM signal supplied to the row to be scanned (that is, the fifth row) is 1/n of the brightness according to the PWM signal supplied to the row being scanned that is adjacent to the fifth row (that is, the fourth row). Since the fifth STH signal STH5 is activated, the STH counter value is increased from "100" to "101".

Figure 6:
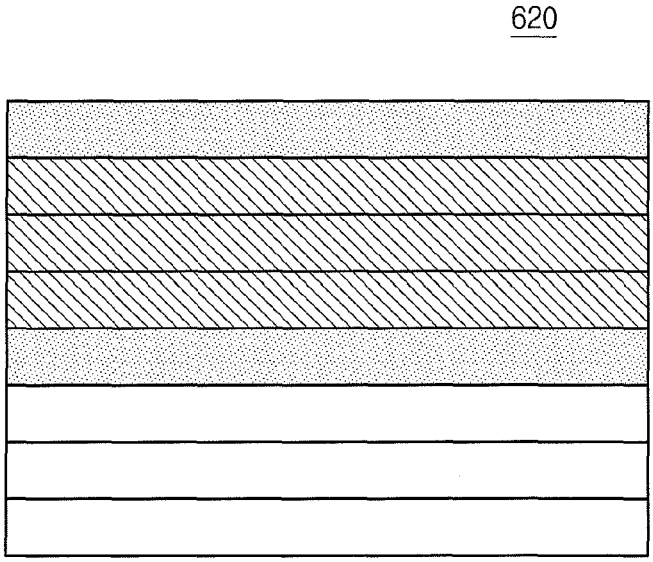

The backlight unit 620 corresponding to an interval between times (t5 and t6) is shown in FIG. 6. The PWM signal corresponding to the brightness of the second to fourth rows of the backlight unit 620 is supplied to the second to fourth rows of the backlight unit 620. The PWM signal corresponding to 1/n of the brightness of the second row is supplied to the first row of the backlight unit 620 and the PWM signal corresponding to 1/n of the brightness of the fourth row is supplied to the fifth row of the backlight unit 620. For example, the PWM signal corresponding to ½ of the brightness of the second row is supplied to the first row of the backlight unit 620 and the PWM signal corresponding to ½ of the brightness of the fourth row is supplied to the fifth row of the backlight unit 620.

The fifth latch signal LS5 is activated and the PWM signal corresponding to the brightness of the fifth row of the backlight unit 620 is supplied to the fifth row of the backlight unit 620 at sixth time (t6). In addition, the second latch signal LS2 corresponding to the second row of the backlight unit 620 is deactivated. The scanning control circuit 612 performs the post-scanning by supplying the PWM signal to the row of the backlight unit 612 which has been scanned, that is, the second row of the backlight unit 620. The brightness according to the PWM signal supplied to the scanned row (that is, the second row) is 1/n of the brightness according to the PWM signal supplied to the row being scanned that is adjacent to the second row (that is, the third row).

In addition, the sixth STH signal STH6 corresponding to the sixth row of the backlight unit 620 is activated. The scanning control circuit 612 supplies the PWM signal to the row to be scanned in the next timing, that is, the sixth row of the backlight unit 620, to perform the pre-scanning. The brightness according to the PWM signal supplied to the row to be scanned (that is, the sixth row) is 1/n of the brightness according to the PWM signal supplied to the row being scanned that is adjacent to the sixth row (that is, the fifth row). Since the sixth STH signal STH6 is activated, the STH counter value is increased from "101" to "110".

Figure 7:
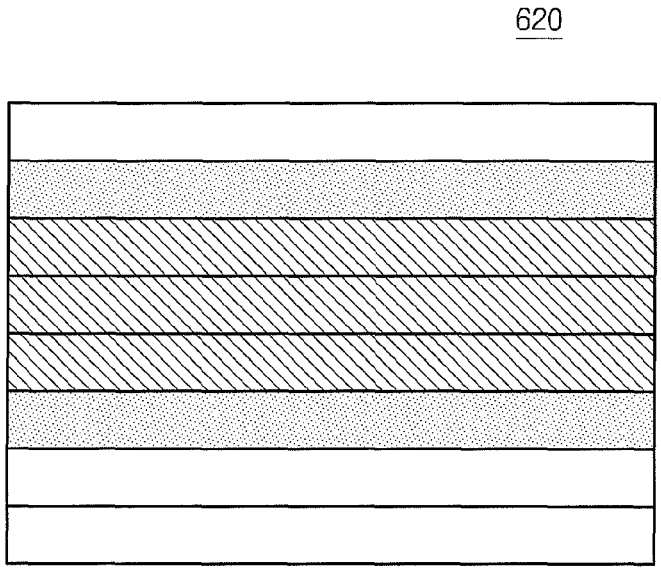

The backlight unit 620 corresponding to an interval between times (t6 and t7) is shown in FIG. 7. The PWM signal corresponding to the brightness of the third to fifth rows of the backlight unit 620 is supplied to the third to fifth rows of the backlight unit 620. The PWM signal corresponding to 1/n of the brightness of the third row is supplied to the second row of the backlight unit 620 and the PWM signal corresponding to 1/n of the brightness of the fifth row is supplied to the sixth row of the backlight unit 620.

The sixth latch signal LS6 is activated and the PWM signal corresponding to the brightness of the sixth row of the backlight unit 620 is supplied to the sixth row of the backlight unit 620 at seventh time (t7). In addition, the third latch signal LS3 corresponding to the third row of the backlight unit 620 is deactivated. The scanning control circuit 612 performs the post-scanning by supplying the PWM signal to the row of the backlight unit 612 which has been scanned, that is, the third row of the backlight unit 620. The brightness according to the PWM signal supplied to the scanned row (that is, the third row) is 1/n of the brightness according to the PWM signal supplied to the row being scanned that is adjacent to the third row (that is, the fourth row).

In addition, the seventh STH signal STH7 corresponding to the seventh row of the backlight unit 620 is activated. The scanning control circuit 612 supplies the PWM signal to the row to be scanned in the next timing, that is, the seventh row of the backlight unit 620, to perform the pre-scanning. The brightness according to the PWM signal supplied to the row to be scanned (that is, the seventh row) is 1/n of the brightness according to the PWM signal supplied to the row being scanned that is adjacent to the seventh row (that is, the sixth row). Since the seventh STH signal STH7 is activated, the STH counter value is increased from "110" to "111".

Figure 8:
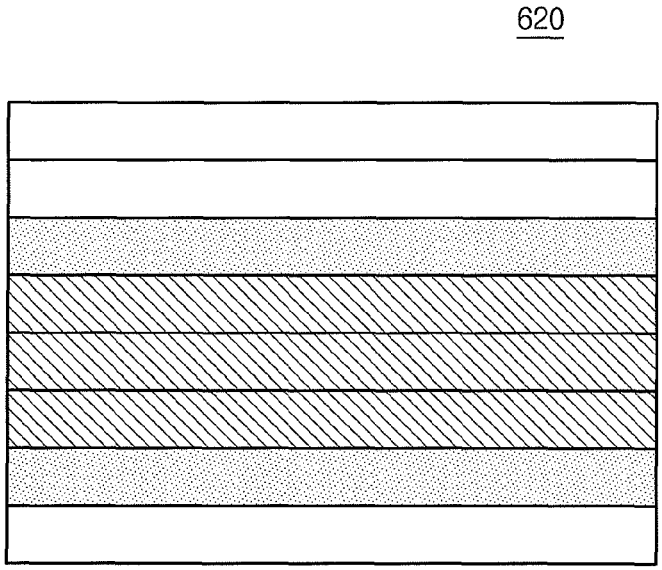

The backlight unit 620 corresponding to an interval between times (t7 and t8) is shown in FIG. 8. The PWM signal corresponding to the brightness of the fourth to sixth rows of the backlight unit 620 is supplied to the fourth to sixth rows of the backlight unit 620. The PWM signal corresponding to 1/n of the brightness of the fourth row is supplied to the third row of the backlight unit 620 and the PWM signal corresponding to 1/n of the brightness of the sixth row is supplied to the seventh row of the backlight unit 620.

The seventh latch signal LS7 is activated and the PWM signal corresponding to the brightness of the seventh row of the backlight unit 620 is supplied to the seventh row of the backlight unit 620 at eighth time (t8). In addition, the fourth latch signal LS4 corresponding to the fourth row of the backlight unit 620 is deactivated. The scanning control circuit 612 performs the post-scanning by supplying the PWM signal to the row of the backlight unit 612 which has been scanned, that is, the fourth row of the backlight unit 620. The brightness according to the PWM signal supplied to the scanned row (that is, the fourth row) is 1/n of the brightness according to the PWM signal supplied to the row being scanned that is adjacent to the fourth row (that is, the fifth row).

In addition, the eighth STH signal STH8 corresponding to the eighth row of the backlight unit 620 is activated. The scanning control circuit 612 supplies the PWM signal to the row to be scanned in the next timing, that is, the eighth row of the backlight unit 620, to perform the pre-scanning. The brightness according to the PWM signal supplied to the row to be scanned (that is, the eighth row) is 1/n of the brightness according to the PWM signal supplied to the row being scanned that is adjacent to the eighth row (that is, the seventh row). Since the eighth STH signal STH8 is activated, the STH counter value is increased from "111" to "000".

Figure 9:
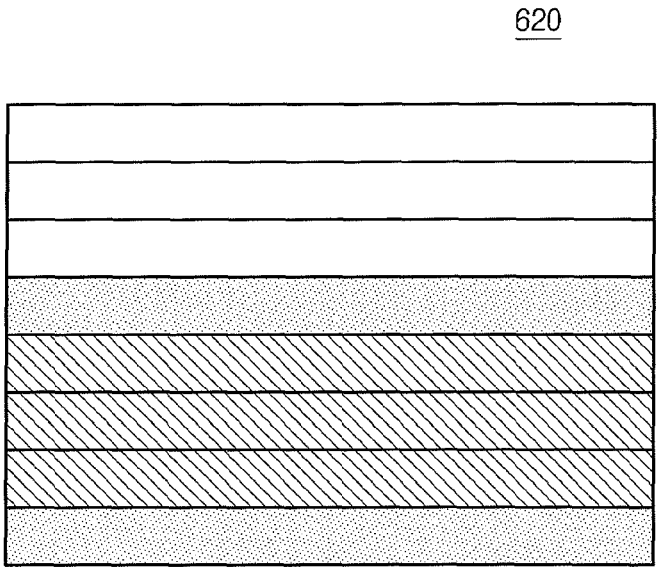

The backlight unit 620 corresponding to an interval between times (t8 and t9) is shown in FIG. 9. The PWM signal corresponding to the brightness of the fifth to seventh rows of the backlight unit 620 is supplied to the fifth to seventh rows of the backlight unit 620. The PWM signal corresponding to 1/n of the brightness of the fifth row is supplied to the fourth row of the backlight unit 620 and the PWM signal corresponding to 1/n of the brightness of the seventh row is supplied to the eighth row of the backlight unit 620.

The eighth latch signal LS8 is activated and the PWM signal corresponding to the brightness of the eighth row of the backlight unit 620 is supplied to the eighth row of the backlight unit 620 at ninth time (t9). In addition, the fifth latch signal LS5 corresponding to the fifth row of the backlight unit 620 is deactivated. The scanning control circuit 612 performs the post-scanning by supplying the PWM signal to the row of the backlight unit 612 which has been scanned, that is, the fifth row of the backlight unit 620. The brightness according to the PWM signal supplied to the scanned row (that is, the fifth row) is 1/n of the brightness according to the PWM signal supplied to the row being scanned that is adjacent to the fifth row (that is, the sixth row).

In addition, the first STH signal STH1 corresponding to the first row of the backlight unit 620 is activated. At this time, the scanning control circuit 612 does not perform the pre-scanning with respect to the row to be scanned in the next timing, that is, the first row of the backlight unit 620. Since the first STH signal STH1 is activated, the STH counter value is increased from "000" to "001".

Figure 10:
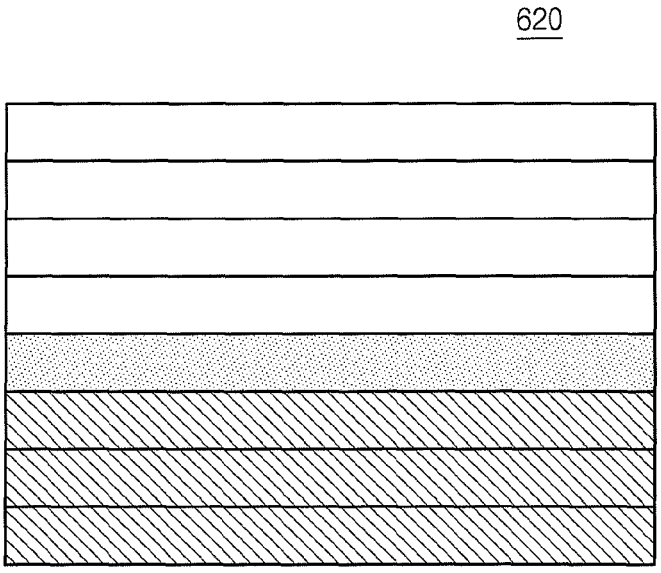

The backlight unit 620 corresponding to an interval between times (t9 and t10) is shown in FIG. 10. The PWM signal corresponding to the brightness of the sixth to eighth rows of the backlight unit 620 is supplied to the sixth to eighth rows of the backlight unit 620. The PWM signal corresponding to 1/n of the brightness of the sixth row is supplied to the fifth row of the backlight unit 620.

The first latch signal LS1 is activated and the PWM signal corresponding to the brightness of the first row of the backlight unit 620 is supplied to the first row of the backlight unit 620 at tenth time (t10). In addition, the sixth latch signal LS6 corresponding to the sixth row of the backlight unit 620 is deactivated. The scanning control circuit 612 performs the post-scanning by supplying the PWM signal to the row of the backlight unit 612 which has been scanned, that is, the sixth row of the backlight unit 620. The brightness according to the PWM signal supplied to the scanned row (that is, the sixth row) is 1/n of the brightness according to the PWM signal supplied to the row being scanned that is adjacent to the sixth row (that is, the seventh row).

In addition, the second STH signal STH2 corresponding to the second row of the backlight unit 620 is activated. The scanning control circuit 612 supplies the PWM signal to the row to be scanned in the next timing, that is, the second row of the backlight unit 620, to perform the pre-scanning. The brightness according to the PWM signal supplied to the row to be scanned (that is, the second row) is 1/n of the brightness according to the PWM signal supplied to the row being scanned that is adjacent to the second row (that is, the first row). Since the second STH signal STH2 is activated, the STH counter value is increased from "001" to "010".

Figure 11:
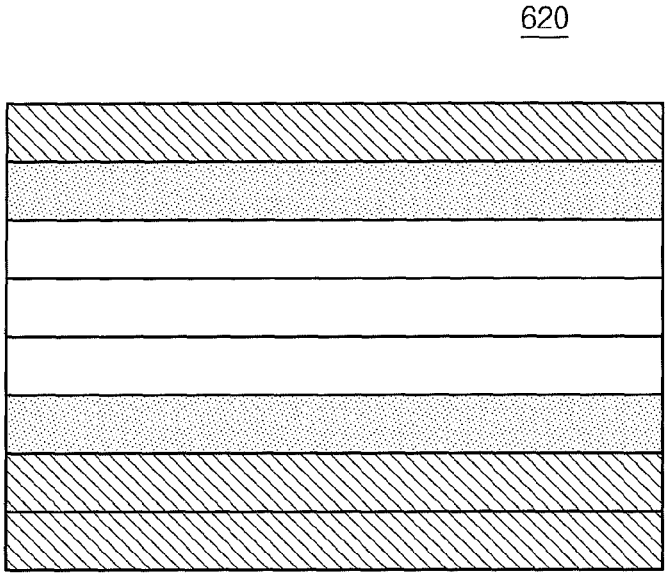

The backlight unit 620 corresponding to an interval between times (t10 and t11) is shown in FIG. 11. The PWM signal corresponding to the brightness of the first, seventh, and eighth rows of the backlight unit 620 is supplied to the first, seventh, and eighth rows of the backlight unit 620. The PWM signal corresponding to 1/n of the brightness of the seventh row is supplied to the sixth row of the backlight unit 620 and the PWM signal corresponding to 1/n of the brightness of the first row is supplied to the second row of the backlight unit 620.

The second latch signal LS2 is activated and the PWM signal corresponding to the brightness of the second row of the backlight unit 620 is supplied to the second row of the backlight unit 620 at eleventh time (t11). In addition, the seventh latch signal LS7 corresponding to the seventh row of the backlight unit 620 is deactivated. The scanning control circuit 612 performs the post-scanning by supplying the PWM signal to the row of the backlight unit 612 which has been scanned, that is, the seventh row of the backlight unit 620. The brightness according to the PWM signal supplied to the scanned row (that is, the seventh row) is 1/n of the brightness according to the PWM signal supplied to the row being scanned that is adjacent to the seventh row (that is, the eighth row).

In addition, the third STH signal STH3 corresponding to the third row of the backlight unit 620 is activated. The scanning control circuit 612 supplies the PWM signal to the row to be scanned in the next timing, that is, the third row of the backlight unit 620, to perform the pre-scanning. The brightness according to the PWM signal supplied to the row to be scanned (that is, the third row) is 1/n of the brightness according to the PWM signal supplied to the row being scanned that is adjacent to the third row (that is, the second row). Since the third STH signal STH3 is activated, the STH counter value is increased from "010" to "011".

Figure 12:
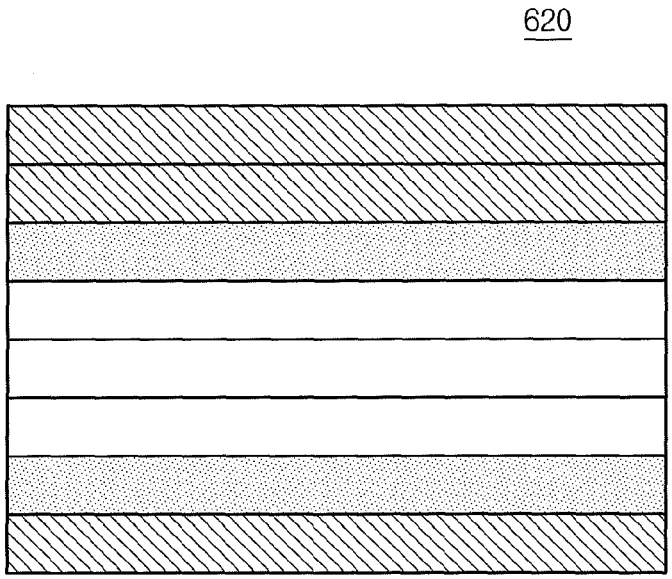

The backlight unit 620 corresponding to an interval between times (t11 and t12) is shown in FIG. 12. The PWM signal corresponding to the brightness of the first, second and eighth rows of the backlight unit 620 is supplied to the first, second and eighth rows of the backlight unit 620. The PWM signal corresponding to 1/n of the brightness of the eighth row is supplied to the seventh row of the backlight unit 620 and the PWM signal corresponding to 1/n of the brightness of the second row is supplied to the third row of the backlight unit 620.

The third latch signal LS3 is activated and the PWM signal corresponding to the brightness of the third row of the backlight unit 620 is supplied to the third row of the backlight unit 620 at twelfth time (t12). In addition, the eighth latch signal LS8 corresponding to the eighth row of the backlight unit 620 is deactivated. The scanning control circuit 612 does not perform the post-scanning with respect to the row of the backlight unit 612 which has been scanned, that is, the eighth row of the backlight unit 620.

In addition, the fourth STH signal STH4 corresponding to the fourth row of the backlight unit 620 is activated. The scanning control circuit 612 supplies the PWM signal to the row to be scanned in the next timing, that is, the fourth row of the backlight unit 620, to perform the pre-scanning. The brightness according to the PWM signal supplied to the row to be scanned (that is, the fourth row) is 1/n of the brightness according to the PWM signal supplied to the row being scanned that is adjacent to the fourth row (that is, the third row). Since the fourth STH signal STH4 is activated, the STH counter value is increased from "011" to "100".

Figure 13:
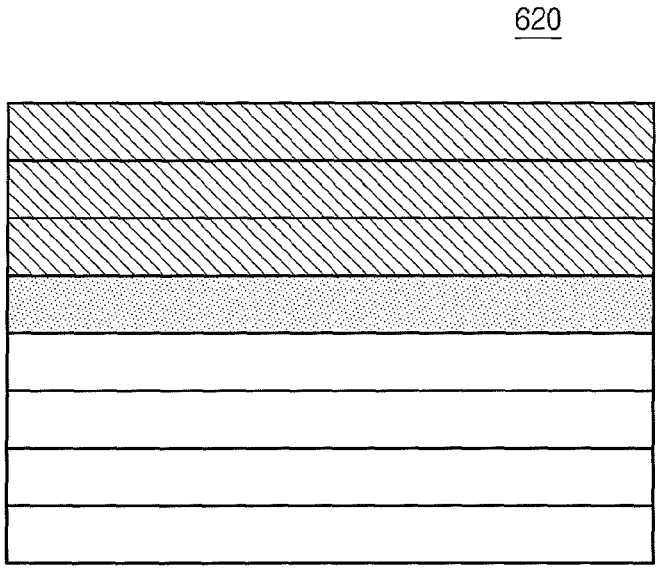

The backlight unit 620 corresponding to an interval between times (t12 and t13) is shown in FIG. 13. The PWM signal corresponding to the brightness of the first to third rows of the backlight unit 620 is supplied to the first to third rows of the backlight unit 620. The PWM signal corresponding to 1/n of the brightness of the third row is supplied to the fourth row of the backlight unit 620.

The fourth latch signal LS4 is activated and the PWM signal corresponding to the brightness of the fourth row of the backlight unit 620 is supplied to the fourth row of the backlight unit 620 at thirteenth time (t13). In addition, the first latch signal LS1 corresponding to the first row of the backlight unit 620 is deactivated. The scanning control circuit 612 performs the post-scanning by supplying the PWM signal to the row of the backlight unit 612 which has been scanned, that is, the first row of the backlight unit 620. The brightness according to the PWM signal supplied to the scanned row (that is, the first row) is 1/n of the brightness according to the PWM signal supplied to the row being scanned that is adjacent to the first row (that is, the second row).

In addition, the fifth STH signal STH5 corresponding to the fifth row of the backlight unit 620 is activated. The scanning control circuit 612 supplies the PWM signal to the row to be scanned in the next timing, that is, the fifth row of the backlight unit 620, to perform the pre-scanning. The brightness according to the PWM signal supplied to the row to be scanned (that is, the fifth row) is 1/n of the brightness according to the PWM signal supplied to the row being scanned that is adjacent to the fifth row (that is, the fourth row). Since the fifth STH signal STH5 is activated, the STH counter value is increased from "100" to "101".

Figure 14:
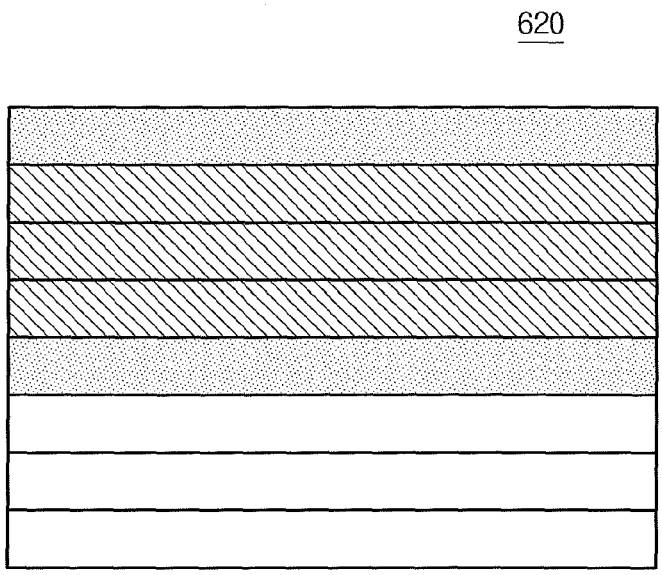

The backlight unit 620 corresponding to an interval between times (t13 and t14) is shown in FIG. 14. The PWM signal corresponding to the brightness of the second to fourth rows of the backlight unit 620 is supplied to the second to fourth rows of the backlight unit 620. The PWM signal corresponding to 1/n of the brightness of the second row is supplied to the first row of the backlight unit 620 and the PWM signal corresponding to 1/n of the brightness of the fourth row is supplied to the fifth row of the backlight unit 620.

As described above with reference to FIGS. 2 to 14, according to a backlight unit according to an embodiment of the invention and a liquid crystal display according to an embodiment of the invention having the backlight unit, a PWM signal having a brightness level lower than that of the PWM signal supplied to the rows being scanned is supplied to the rows adjacent to the rows being scanned. For example, pre-scanning is performed with respect to the rows to be scanned in the next timing, and post-scanning is performed with respect to the rows that have been scanned.

If the first row of the backlight unit 620 is scanned in the next timing, the pre-scanning is not performed with respect to the first row of the backlight unit 620. If the last row of the backlight unit 620 has been scanned, the post-scanning is not performed with respect to the last row of the backlight unit 620.

According to exemplary embodiments of the invention, the rows subject to the pre-scanning or post-scanning may exist between rows being scanned and rows maintained in the OFF state. The brightness value of the rows subject to the pre-scanning or post-scanning is lower than that of the rows being scanned and higher than that of the rows maintained in the OFF state. Thus, the brightness difference between the rows of the backlight unit 620 can be reduced. Since the brightness difference of light supplied to the liquid crystal cells can be reduced, the waterfall can be reduced or prevented.

In addition, the brightness of the rows subject to the pre-scanning or the post-scanning corresponds to 1/n of the brightness of the rows adjacent to the rows being scanned. The level or the pulse width of the PWM signal supplied to the rows subject to the pre-scanning or the post-scanning can be adjusted based on the level or the pulse width of the PWM signal supplied to the rows adjacent to the rows being scanned.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A liquid crystal display comprising:

a liquid crystal panel that displays an image signal;

a backlight unit that supplies a light to the liquid crystal panel; and a backlight control circuit that controls a brightness of the backlight unit, wherein the backlight control circuit comprises a scanning control circuit scanning the backlight unit in a row direction by supplying a first pulse width modulation signal to the backlight unit, and scanning rows of the backlight unit adjacent to the scanned rows by supplying a second pulse width modulation signal to the rows adjacent to the scanned rows such that the rows adjacent to the scanned rows have a brightness lower than a brightness of the scanned rows, wherein the scanning control circuit performs a pre-scanning by supplying the second pulse width modulation signal to rows to be scanned in a next scanning timing, and performs a post-scanning by supplying the second pulse width modulation signal to the rows that have been scanned in a previous scanning timing.

2. The liquid crystal display of claim 1, wherein, if a row to be scanned is a first row of the backlight unit, the pre-scanning is not performed.

3. The liquid crystal display of claim 1, wherein the second pulse width modulation signal has a brightness level lower than a brightness level of the first pulse width modulation signal.

4. The liquid crystal display of claim 3, wherein the rows receiving the second pulse width modulation signal have a brightness corresponding to 1/n of a brightness of the rows being scanned.

5. The liquid crystal display of claim 1, wherein the scanning control circuit does not perform post-scanning if the scanned row is a last row of the backlight unit.

6. The liquid crystal display of claim 1, wherein the second pulse width modulation signal has a brightness level lower than a brightness level of the first pulse width modulation signal.

7. The liquid crystal display of claim 6, wherein the rows receiving the second pulse width modulation signal have a brightness corresponding to 1/n of brightness of the scanned rows.

8. A backlight unit comprising:

a backlight unit that supplies a light to a liquid crystal panel; and a backlight control circuit that controls a brightness of the backlight unit, wherein the backlight control circuit comprises a scanning control circuit scanning the backlight unit in a row direction by supplying a first pulse width modulation signal to the backlight unit, and scanning rows of the backlight unit adjacent to the scanned rows by supplying a second pulse width modulation signal to the rows adjacent to the scanned rows such that the rows adjacent to the scanned rows have a brightness lower than a brightness of the scanned rows, wherein the scanning control circuit performs a pre-scanning by supplying the second pulse width modulation signal to rows to be scanned in a next scanning timing, and performs a post-scanning by supplying the second pulse width modulation signal to rows that have been scanned in a previous scanning timing.

9. The backlight unit of claim 8, wherein the second pulse width modulation signal has a brightness level lower than a brightness level of the first pulse width modulation signal.

10. The backlight unit of claim 8, wherein the second pulse width modulation signal has a brightness level lower than a brightness level of the first pulse width modulation signal.

11. A backlight unit comprising:

a backlight unit that supplies a light to a liquid crystal panel; and a backlight control circuit that controls a brightness of the backlight unit, wherein the backlight control circuit comprises a scanning control circuit scanning the backlight unit in a row direction by supplying a first pulse width modulation signal to the backlight unit, and performing a pre-scanning by supplying a second pulse width modulation signal to rows to be scanned in a next scanning timing, and performing a post-scanning by supplying the second pulse width modulation signal to rows that have been scanned in a previous scanning timing.

12. The backlight unit of claim 11, wherein the second pulse width modulation signal has a brightness level lower than a brightness level of the first pulse width modulation signal.

13. The backlight unit of claim 12, wherein the rows receiving the second pulse width modulation signal have a brightness corresponding to 1/n of a brightness of the rows being scanned.

14. The backlight unit of claim 11, wherein, if a row to be scanned is a first row of the backlight unit, the pre-scanning is not performed.

15. The backlight unit of claim 11, wherein the scanning control circuit does not perform post-scanning if the scanned row is a last row of the backlight unit.

* * * * *